United States Patent [19]

Hayfield

[11] Patent Number: 4,502,936

[45] Date of Patent: Mar. 5, 1985

[54] ELECTRODE AND ELECTROLYTIC CELL

[75] Inventor: Peter C. S. Hayfield, Church Garth, England

[73] Assignee: IMI Kynoch Limited, Birmingham, England

[21] Appl. No.: 323,579

[22] Filed: Nov. 20, 1981

[30] Foreign Application Priority Data

Nov. 26, 1980 [GB] United Kingdom ..... 8037933

[51] Int. Cl.[3] ..... C23F 13/00; C25B 11/08

[52] U.S. Cl. ..... 204/290 F; 204/196; 204/291; 204/38.4; 204/29; 427/125

[58] Field of Search ..... 204/291, 290 F, 128, 204/270, 98, 196, 280, 29, 56 R, 35 R, 38 R, 38 A, 38 B, 38 S, 37 R; 428/433, 632; 427/125, 126.5, 343, 126.3

[56] References Cited

U.S. PATENT DOCUMENTS

| | | | |
|---|---|---|---|
| 2,719,797 | 10/1955 | Rosenblatt et al. | 204/37 R |
| 3,657,784 | 4/1972 | Selman et al. | 428/632 |
| 3,711,385 | 1/1973 | Beer et al. | 427/126.3 |
| 3,773,554 | 11/1973 | Scrutton et al. | 427/126.5 |
| 3,773,555 | 11/1973 | Cotton et al. | 427/126.5 |
| 4,029,566 | 6/1977 | Brandmair et al. | 204/290 F |
| 4,039,400 | 8/1977 | Hayfield | 204/290 F |
| 4,240,878 | 12/1980 | Carter | 204/290 F |
| 4,248,906 | 2/1981 | Satio et al. | 427/125 |
| 4,313,814 | 2/1982 | Satio et al. | 204/290 F |
| 4,323,437 | 4/1982 | Mucenieks | 204/98 |
| 4,358,475 | 11/1982 | Brown et al. | 427/34 |
| 4,395,436 | 7/1983 | Bianchi et al. | 427/53.1 |
| 4,422,917 | 12/1983 | Hayfield | 204/196 |

FOREIGN PATENT DOCUMENTS

| | | |
|---|---|---|
| 232679 | 4/1925 | United Kingdom . |
| 232680 | 4/1925 | United Kingdom . |
| 1231280 | 5/1971 | United Kingdom . |
| 1438462 | 6/1976 | United Kingdom . |

*Primary Examiner*—Brian E. Hearn
*Assistant Examiner*—Nathan Thane
*Attorney, Agent, or Firm*—Cushman, Darby & Cushman

[57] ABSTRACT

An electrode particularly useful in hypochlorite cells operating at low temperatures or in metal winning cells in which the electrode comprises a titanium substrate with a platinum metal coating and an intermediate coating of substoichiometric tantalum oxide.

8 Claims, 2 Drawing Figures

ELECTRODE AND ELECTROLYTIC CELL

BACKGROUND OF THE INVENTION

This invention relates to electrodes for electrochemical processes and to electrochemical cells and has particular reference to hypochlorite cells operating at low temperatures and to zinc winning cells. It is well known to make an electrode for use in an electrochemical cell from titanium with an anodically active coating. Titanium is chosen for its corrosion resistance which is related to the formation of an adherent oxide film on the titanium surface. The oxide film prevents a corrosion attack on the substrate titanium metal itself when the electrode is in use. Conventionally the titanium substrate is coated with a layer of a platinum group metal which forms an anodically active coating. The term "platinum group metal" as used herein is intended to cover metals chosen from the group platinum, iridium, palladium, rhodium, ruthenium and alloys thereof.

Although the presence of the oxide film on titanium will substantially increase the resistance to corrosion of the material, there are circumstances in which the titanium can corrode when operated as an anode with an anodically active coating on its surface. In these circumstances the anode tends to fail by reason of detachment of the anodically active surface and its falling off the anode rather than electrochemical wear of the anodically active material itself. Two particular applications for anodically active coated titanium in which this detachment is a problem are:

1. the operation of a hypochlorite cell at low temperatures (below 10° C.); and
2. the use of an anode in zinc winning from a zinc sulphate solution.

As will be explained in more detail below there are particular problems associated with the operation of hypochlorite cells at temperatures below 10° C. and also there are problems in providing an economically viable anode for use in metal winning operations where such anode is based on a coated titanium substrate.

The present invention is concerned with an electrode which has improved operating characteristics under the circumstances where the anodically active material is liable to become detached. It should be pointed out that in many cases it is not understood why the anodically active material becomes detached nor why the invention as set out below leads to an improvement in properties of the electrode.

SUMMARY OF THE INVENTION

By the present invention there is provided a method of manufacturing an electrode for use in an electrolytic cell, which method includes the steps of forming on the surface of a titanium substrate a coating by:

i. forming a layer of an oxide of a metal chosen from the group titanium, tantalum, zirconium, hafnium and niobium on the titanium surface,
ii. heat treating the layer in a vacuum or in a non-oxidising atmosphere, said atmosphere being substantially hydrogen-free, at a temperature and for a time sufficient for the titanium partially to reduce the oxide,
iii. applying to the oxide layer a layer of an anodically active material.

The layer of oxide may be titanium oxide, deposited on the surface of the titanium by immersing the titanium surface into an acid solution containing trivalent titanium cations, maintaining the solution at a temperature in excess of 75° C. and rendering the titanium surface anodic with respect to a cathode to anodically oxidise the titanium cations to form titanium oxide which is deposited onto the titanium surface as an adherent porous titanium oxide layer.

Alternatively the oxide may be tantalum oxide formed by applying a paint of a tantalum-containing compound to the surface and heating the surface in air or an oxygen-containing atmosphere to convert the compound to an oxide of tantalum.

The anodically active coating may contain a platinum group metal or oxide or an alloy or mixture of platinum group metals or oxides.

The platinum group metal, oxide, alloy or mixture may be applied by a route selected from the group:

i. applying a paint containing an organic or inorganic compound of the platinum group metal(s) to the surface and heating in air or an oxygen-containing atmosphere at a temperature in the range 350° C. to 650° C. to convert the compound to the metal(s) or oxide(s),
ii. electroplating the platinum group metal onto the oxide layer or onto a previously applied painted and fired platinum group metal layer.

The present invention further provides an electrode for electrochemical processes comprising a substrate of titanium or an alloy thereof, an intermediate coating of sub-stoichiometric tantalum oxide and an outer layer of anodically active material. The anodically active material may be a coating containing a platinum group metal or oxide or an alloy or mixture of platinum group metals or oxides.

The present invention yet further provides an electrochemical cell including an anode and a cathode surrounded by an electrolyte wherein the anode comprises an electrode manufactured by a method as set out above or is an electrode of the type set out above.

The electrochemical cell is preferably a hypochlorite cell adapted and arranged to generate sodium hypochlorite from an aqueous sodium chloride solution, particularly adapted for operation and capable of operation at temperatures of 10° C. or below.

Alternatively the electrochemical cell may include an electrolyte of an acidified sulphate solution, particularly a solution containing ions of a metal chosen from the group zinc, copper, nickel or cobalt.

The coated titanium surface may be heated in a vacuum at a temperature in the range 500° C. to 1000° C. for a time in excess of 5 minutes, preferably in the range 5 minutes to 168 hours. The temperature is preferably in the range 700° C. to 850° C.

The titanium is preferably pretreated before coating with the tantalum-containing compound to remove any surface oxide on the surface of the titanium. The tantalum-containing compound may be a tantalum resinate or an inorganic tantalum compound contained in an organic carrier.

The present invention particularly provides an electrochemical cell for the generation of sodium hypochlorite from an aqueous sodium chloride solution, the cell comprising an anode and a cathode wherein the anode is an electrode of the type set out above or the anode is manufactured by the method set out above.

The present invention also provides a method of operating an electrochemical cell for the generation of sodium hypochlorite from an aqueous sodium chloride solution which comprises operating an electrochemical cell of the type set out above and supplying to the cell an aqueous sodium chloride solution at temperatures of 10° C. or below.

The present invention yet further provides a method of electrowinning a metal from a solution of the metal which comprises the steps of inserting into the solution containing ions of the metal an anode and a cathode and passing an electrical current between the anode and the cathode so as to deposit the metal on the cathode wherein the improvement comprises using as an anode an electrode of the type set out above or an electrode manufactured by the method set out above.

BRIEF DESCRIPTION OF THE DRAWINGS

By way of example embodiments of the present invention will now be described with reference to the accompanying drawings which are graphs of precious metal loading against time.

DESCRIPTION OF THE PREFERRED EMBODIMENTS

Figure 1:
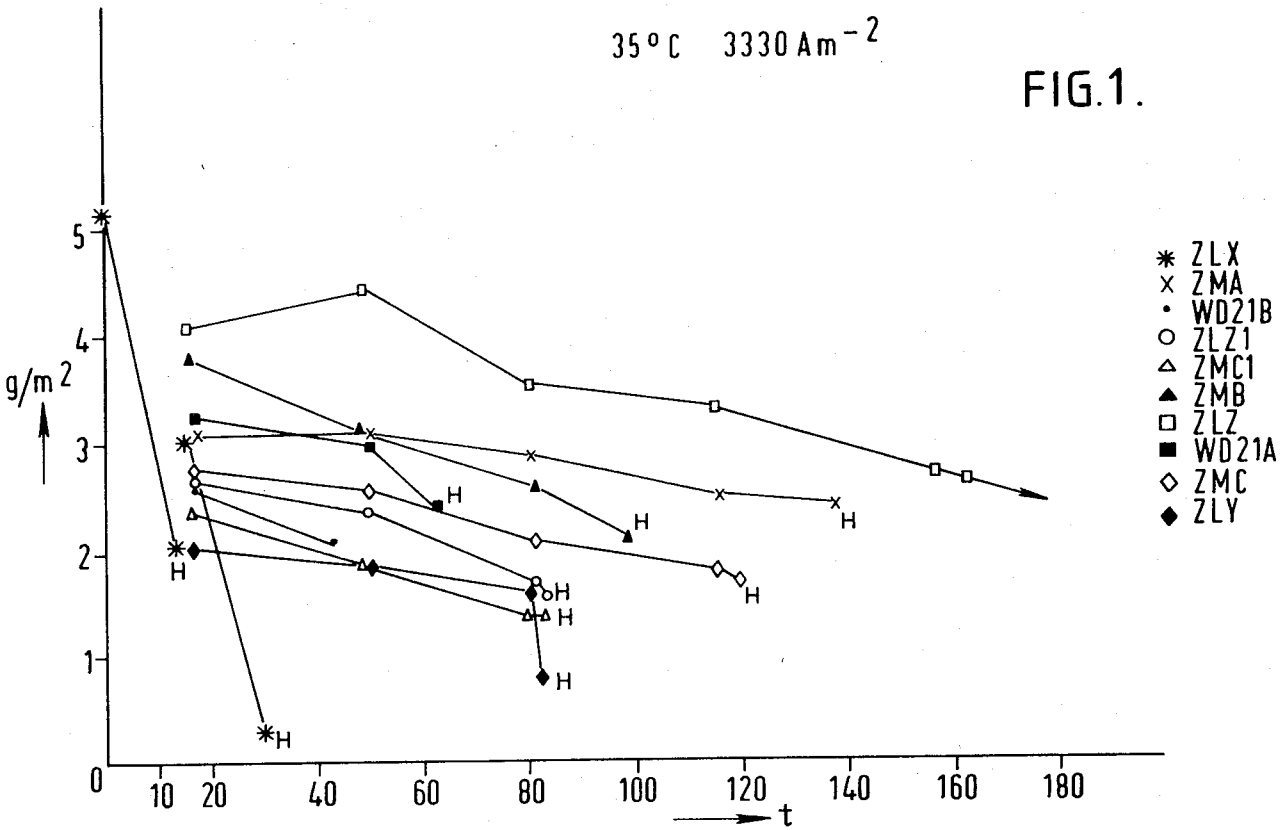

A sheet of commercial purity titanium was etched in 10% oxalic acid for a time betwen 8 and 16 hours. The titanium sheet was then immersed in a 7 wt % sulphuric acid solution containing 5 g/l of titanium as $Ti^{3+}$ ions. The titanium sheet was connected as an anode relative to a lead cathode and a potential of 12 v was applied. The anode current density was maintained in the region of 60 A/m$^2$. The solution was maintained at 80° C. A coating of titanium dioxide was deposited upon the titanium sheet at a rate of approximately 2 g/m$^2$/hr.

Coating was continued for a period of 7½ hours to produce an overall coating loading of 15 g/m$^2$.

After coating the titanium sheet was washed in water and dried and a white titanium oxide coating was found to be firmly adherent to the titanium substrate.

The titanium substrate with the titanium dioxide coating was then transferred to a vacuum furnace and heated in a vacuum at a temperature of 750° C. for 6 hours. On cooling and removal of the sample from the furnace it was found that the sample had become black. This technique is the basis of the manufacture of a series of ten samples which were prepared and utilised as anodes in an acid solution containing 165 g/l $H_2SO_4$ 115 ppm chloride and 5 ppm fluoride. Details of the samples are given in Tables Ia and Ib below.

TABLE Ib-continued

| Sample No | Anode Overpotentials in $H_2SO_4$ (MV) At 666 A/m$^2$ | At 3 kA/m$^2$ |
|---|---|---|
| WD21(B) | 485 | 700 |
| ZLZ | 435 | 650 |
| ZLZ(1) | 530 | 700 |
| ZMA | 460 | 615 |
| ZMB | 445 | 630 |
| ZMC | 375 | 500 |
| ZMC(1) | 545 | 680 |

In Table I the precoat loading refers to the titanium oxide loading applied in accordance with the method set out above, Where two or more precoat loadings are shown, the first coat was subsequently given a heat treatment at 150° C. in air and the second coat would be applied thereafter. Where three coats are applied the second coat would merely be dried out prior to the application of a third coat. In the column headed "vacuum heat treatment" the number prior to the slash refers to the temperature in °C. and the number after the slash refers to the time in hours. The reference to "TNBT loading" is to the loading of tetra-n-butyl titanate applied to the already reduced titanium oxide coating. The reference to "PHT" is post heat treatment. The anode over-potentials at 35° C. are in millivolts at a current density of 666 A/m$^2$ and 3000 A/m$^2$.

Figure 2:
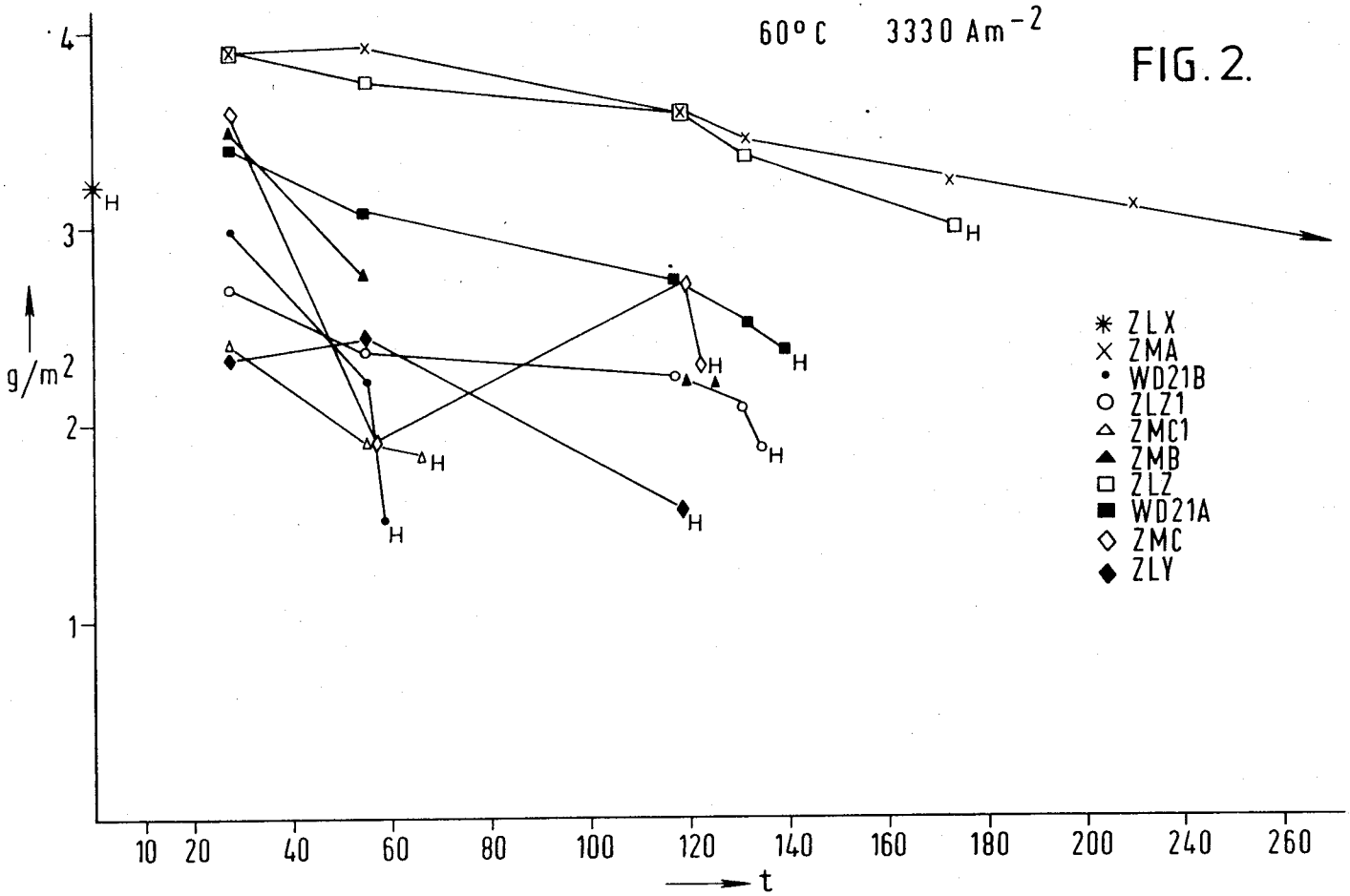

The durability of the anodes is most clearly seen in FIGS. 1 and 2. In the figures, t is time in days and g/m$^2$ is applied noble metal coating in g/m$^2$. Anode samples ZLX exhibited high overpotential (H) after 13 days or, at a maximum, 27 days when the temperature was 35° C. At 60° C. a high overpotential occurred almost immediately. By comparison, however, it can be seen that anodes manufactured with substrates in accordance with the invention had vastly increased lives and sample ZMA was still continuing to operate after 260 days at 60° C. Improvements of this magnitude are obviously very significant. It can be seen, therefore, that the material improvement in useful life of the anodes manufactured in accordance with the present invention would lead to economically more viable anodes being prepared, whereas with the anodes without the corrosion resistant coating the short life of the anodes would make them less viable. It will be appreciated that operation of TABLE Ia

| Sample No | Precoat Loading (g/m$^2$) 1st | 2nd | 3rd | Air HT 500° C./1 hr | Vac HT (°C./hr) | TNBT Loading (g/m$^2$) | Vac HT (°C./hr) | TNBT Loading (g/m$^2$) | Ir Loading (g/m$^2$) | PHT 400° C./20 hrs |
|---|---|---|---|---|---|---|---|---|---|---|
| ZLX | | | | | | | | | 5.2 | √ |
| ZLY | 13.5 | 13.6 | 17.7 | √ | 750/1 | | | | 4.7 | √ |
| WD21(A) | 13.8 | 14.0 | 11.3 | √ | 750/1 | | | | 5.2 | √ |
| WD21(B) | 13.8 | 14.0 | 11.3 | √ | 800/1 | | | | 5.3 | √ |
| ZLZ | 24.4 | 22.0 | — | √ | 750/1 | 33.3 | 750/1 | — | 6.6 | √ |
| ZLZ(1) | 24.4 | 22.0 | | √ | 750/1 | 33.3 | 750/1 | 5.8 | 7.3 | √ |
| ZMA | 15.0 | 14.0 | 2.0 | √ | 750/1 | 30.6 | 750/1 | — | 6.6 | √ |
| ZMB | 13.0 | 22.0 | — | √ | 750/1 | 32.0 | 800/1 | — | 6.5 | √ |
| ZMC | 15.0 | 15.0 | 17.0 | √ | 750/1 | 31.0 | 800/1 | — | 6.3 | √ |
| ZMC(1) | 15.0 | 15.0 | 17.0 | √ | 750/1 | 31.0 | 800/1 | 5.0 | 6.7 | √ |

TABLE Ib

| Sample No | Anode Overpotentials in $H_2SO_4$ (MV) At 666 A/m$^2$ | At 3 kA/m$^2$ |
|---|---|---|
| ZLX | 435 | 520 |
| ZLY | 445 | 545 |
| WD21(A) | 460 | 565 |

an electrode in an acidifed sulphate solution corresponds to metal winning, as far as the anode is concerned.

It has also been discovered that electrodes having an oxide interlayer in accordance with the invention are more resistant to cathodic degradation. Frequently it is found that if coated titanium anodes become cathodic, for example in an electrowinning cell during shut down, the coating of precious metal can be undermined loosened and may fall off. Anodes having an interlayer, particularly of the ZLY or WD21 A or B type, have a much greater resistance to degradation in these circumstances.

A hypochlorite cell essentially comprises a series of anodes and cathodes immersed in a brine solution and electrically connected so as to pass current between them. The cell functions to generate sodium hypochlorite by anodic oxidation and cathodic reduction of the sodium chloride and a resultant immediate recombination of the ionic species formed at the electrodes so as to form sodium hypochlorite. Such cells are in commercial use to generate sodium hypochlorite from seawater and other brine solutions. Conventionally the anodes used comprise platinum group metal coated titanium.

It has long been known that low temperature inlet seawater (10° C. or less) has an adverse effect on the durability of platinised titanium type electrodes in sodium hypochlorite. This problem first arose in the early 1960s. The phenomonen is associated with the loss of platinum adhesion and peeling. The problems of operation of hypochlorite electrolysers at low temperatures have become widely disseminated since that time. The leading manufacturer of ruthenium oxide coated electrodes advised that their electrolysers should not be operated with seawater at temperatures below 10° C. IMI Marston Limited, another leading manufacturer of electrodes, in this case titanium electrodes with a platinum-iridium containing coating, also advise that the electrodes should not be operated in seawater at temperatures below 10° C. It appears that the coating on a titanium substrate does not wear but becomes undermined, presumably resulting from some activation of the titanium. It is not known why titanium, so corrosion resistant towards seawater in normal cases, should have a weakness when polarised in hypochlorite cells with seawater at 5° C. as opposed to 15° C. Tests carried out on an electrolyser to manufacture sodium hypochlorite from 3% brine gave the following results:

A. Utilising 70/30 platinum/iridium coated titanium electrodes operating at a current density of approximately 2 500 A/m$^2$ initial loading 30.8 g/m$^2$ platinum iridium:
   after 286 hours—16.3 g/m$^2$
   after 714 hours—18.2 g/m$^2$
   after 972 hours—16.2 g/m$^2$
   after 1,008 hours—zero—electrode failed by coating undermining.

B. The platinum electroplate manufactured in accordance with the route set out in British Pat. No. 1 351 741 failed after 3000 hours of operation in brine at 5° C. with a failure resulting from loss of coating adhesion.

C. Ruthenium oxide coated titanium manufactured in accordance with the route set out in Example 5 of British Pat. No. 1 327 760 produced products which failed after 80 hours and 200 hours in duplicate tests in brine at 5° C.

D. Ruthenium oxide applied to titanium produced anodes which failed in brine at 5° C. after 120 hours.

E. By comparison electrodes in accordance with the present invention were manufactured by etching in oxalic acid a sheet of titanium and coating the sheet with 11 g/m$^2$ of tantalum oxide by applying tantalum as a tantalum pentachloride paint in an alcohol. This coated titanium was then heated at 500° C. in air and was then vacuum annealed for one hour at 800° C. Subsequently 22.4 g/m$^2$ of platinum-iridium were applied by painting a series of coats of a platinum-iridium containing paint onto the substrate and firing in air between each painted layer.

The material was evaluated in a laboratory hypochlorite electrolyser at a current density of approximately 2500 A/m$^2$ utilising a 3% aqueous sodium chloride solution at a temperature of 5° C. The test was terminated after 2,735 hours and the following information was revealed.

| Period on test (hrs) | 0 | 236 | 525 | 885 | 1 141 |
|---|---|---|---|---|---|
| Loading g/m$^2$ | 22.4 | 21.8 | 20.8 | 20.9 | 19.3 |
| Period on test (hrs) | 1 421 | 1 732 | 2 186 | 2 400 | 2 735 |
| Loading g/m$^2$ | 18.6 | 18.3 | 17.4 | 16.9 | 15.8 |

Micrographic examination of the sample on termination revealed signs of coating dissolution but no undermining of the coating. A second test was carried out in which 6 g/m$^2$ of tantalum pentoxide were applied to a sheet of titanium and the titanium was then vacuum heat treated as before. 18.2 g of platinum-iridium was then applied by the same process as before and material from that sheet was then tested under identical conditions as set out above. Tests were carried on for a period of 2,132 hours, after which the tests were terminated. The coating loading as measured during the tests is set out below.

| Period on test (hrs) | 0 | 257 | 537 | 848 |
|---|---|---|---|---|
| Loading g/m$^2$ | 18.2 | 18.1 | 17.2 | 15.6 |
| Period on test (hrs) | 1 302 | 1 516 | 1 851 | 2 132 |
| Loading g/m$^2$ | 14.4 | 13.1 | 12.5 | 12.0 |

It is particularly significant to compare this latter test with Example A above. It can be seen that in Example A 18.2 g/m$^2$ of platinum-iridium was present after 714 hours of operation and failure occured at 1,008 hours. By comparison the provision of the sub-stoichiometric tantalum oxide interlayer produced an electrode which had lost only one third of its coating after 2,132 hours. It will be appreciated, therefore, that a very significant increase in coating durability is obtained and the electrode in accordance with the invention is capable of operating under the extremely arduous conditions of a cold hypochlorite cell in a better manner than any known prior electrode.

It will be realised that although hypochlorite electrolysers may not be required to operate all the year round with low temperature inlet seawater there will be periods of the year, particularly during the winter, when this is a very desirable requirement. Although when inlet seawater temperatures are low there is usually less requirement for generation of sodium hypochlorite to restrict bio-fouling, nevertheless the ability of a hypochlorite cell to operate at a low temperature is required by many operators, particularly those carrying out operations in the extreme northern and southern hemispheres.

It has also been discovered that the application of a sub-stoichiometric tantalum oxide (ie $Ta_2O_n$ where n is less than 5 but is not necessarily a whole number) interlayer between a platinum group metal outer layer and a titanium substrate leads to dramatic improvements in life when the electrode is operated as an anode in a zinc winning solution. Zinc is conventionally won from an acidified zinc sulphate solution and an electrode manufactured by coating the titanium substrate with 10 g/m$^2$ of tantalum and subsequently vacuum heat treating the electrode for one hour at 750° C. with an outer layer of 10 g/m$^2$ iridium operated satisfactorily in a zinc winning cell. Furthermore it has unexpectedly been discovered that the coating produced by the method outlined above has a smooth surface and such a smooth surface tends to reduce the accretion of manganese dioxide deposits in a zinc electrowinning cell. Manganese ions are conventionally found in commercial zinc winning cells and manganese dioxide tends to be deposited onto the anode interfering with the electrochemical efficiency of the cell. The electrodes in accordance with the present invention operate satisfactorily in zinc winning solutions, have a smooth surface which tends to decrease manganese dioxide accretion and have a satisfactory electrochemical performance. They also have a low wear rate.

The manganese dioxide which does deposit on the anodes in use can be simply removed by rinsing under a continuous flow of water and drying. Furthermore it is found that there is only a small tendency for the manganese dioxide to build up on the anodes. The deposit tends to fall away in flakes rather than form a hard layer as it does on a lead-silver anode (the conventional anode for zinc winning). The fact that less manganese deposits on the anode results in cleaner cells and a cleaner return acid. Furthermore the lead content of the zinc deposited on the cathode is much less than a quarter of that which is obtained utilising a lead-silver anode. There is a significant improvement in cell operating voltage, particularly when the anodes are new, and there is a slight improvement in cell efficiency. However, even such slight improvements can be significant for large plant operation purposes. After three months of testing in a zinc cell samples having an initial loading of 10 g/m of tantalum oxide and 10 g/m of iridium were found to have lost less than 5% of their coating. Thus a life of up to 5 years can be predicted for electrodes in accordance with the present invention. This is significantly better than any other known platinum group metal containing electrode for use in a metal winning cell.

The application of a tantalum underlayer beneath coatings for use in acid environments also improves the acid undermining resistance of the coating. Thus the best known and most acid undermining resistant coating known to date is the coating described in UK Patent Specification No. 1 351 741. Such a coating essentially comprises a primary layer of platinum which is painted and fired onto the surface onto which is electroplated a further layer of platinum. It has now been discovered that the high acid undermining resistance of this coating can be further improved by the application of an undercoating of tantalum oxide partially reduced by heating in a vacuum.

Such electroplated products or products in which tantalum oxides are used below platinum group metal coatings are also of use in sodium sulphate electrolysis and in sodium persulphuric cells.

It will be further appreciated that other known anodically active coatings, such as lead dioxide or platinum plus 30% iridium coatings, may be applied to the electrodes. In the case of platinum-iridium coatings they may be applied from resinates or chloride compounds of the precious metals dissolved in a suitable organic solvent.

I claim:

1. A method of manufacturing an electrode for use in an electrolytic cell, which method includes the steps of forming on the surface of a titanium substrate a coating by:

i. forming a layer of an oxide of a metal chosen from the group titanium, tantalum, zirconium, hafnium and niobium on the titanium surface, ii. heat treating the layer in a vacuum or in a non-oxidising atmosphere, said atmosphere being substantially hydrogen-free, at a temperature and for a time sufficient for the titanium partially to reduce the oxide, iii. applying to the oxide layer a layer of an anodically active material.

2. A method as claimed in claim 1 in which the oxide is tantalum oxide formed by applying a paint of a tantalum-containing compound to the surface and heating the surface in air or an oxygen-containing atmosphere to convert the compound to an oxide of tantalum.

3. A method as claimed in claim 2 in which the anodically active coating contains a platinum group metal or oxide or an alloy or mixture of platinum group metals or oxides.

4. A method as claimed in claim 3 in which the platinum group metal, oxide, alloy or mixture is applied by a route selected from the group:

i. applying a paint containing an organic or inorganic compound of the platinum group metal(s) to the surface and heating in air or an oxygen-containing atrosphere at a temperature in the range 350° C. to 650° C. to convert the compound to the metal(s) or oxide(s), ii. electroplating the platinum group metal onto the oxide layer or onto a previously applied painted and fired platinum group metal layer.

5. A method as claimed in claim 1 in which the layer of oxide is titanium oxide, deposited on the surface of the titanium by immersing the titanium surface into an acid solution containing trivalent titanium cations, maintaining the solution at a temperature in excess of 75° C. and rendering the titanium surface anodic with respect to a cathode to anodically oxidise the titanium cations to form titanium oxide which is deposited onto the titanium surface as an adherent porous titanium oxide layer.

6. A method as claimed in claim 1 in which the anodically active coating contains a platinum group metal or oxide or an alloy or mixture of platinum group metals or oxides.

7. A method of manufacturing an electrode for use in an electrolytic cell comprising forming a layer of an oxide of a metal selected from the group consisting of titanium, tantalum, zirconium, hafnium and niobium on the titanium surface; heat treating the layer in a vacuum or in a non-oxidising atmosphere, said atmosphere being substantially hydrogen-free, at a temperature and for a time sufficient to form a layer of sub-stoichiometric oxide by partial reduction of the initial oxide layer by the titanium; and applying to the oxide layer a layer of an anodically active material.

8. An electrode for electrochemical processes comprising a substrate of titanium or an alloy thereof, an intermediate coating of sub-stoichiometric oxide of a metal selected from the group consisting of titanium, tantalum, zirconium, hafnium and miobium, which intermediate coating has been formed in situ by partial reduction of the oxide coating by the titanium substrate, and an outer layer of anodically active material.

* * * * *